US009844734B2

(12) United States Patent
Garling

(10) Patent No.: US 9,844,734 B2
(45) Date of Patent: Dec. 19, 2017

(54) SHOOTING TOY

(71) Applicant: LEGO A/S, Billund (DK)

(72) Inventor: Aske Klejnstrup Garling, Odense M (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 14/774,687

(22) PCT Filed: Mar. 12, 2014

(86) PCT No.: PCT/EP2014/054840
§ 371 (c)(1),
(2) Date: Sep. 10, 2015

(87) PCT Pub. No.: WO2014/140102
PCT Pub. Date: Sep. 18, 2014

(65) Prior Publication Data

US 2016/0016086 A1 Jan. 21, 2016

(30) Foreign Application Priority Data

Mar. 12, 2013 (DK) ..... 2013 70148

(51) Int. Cl.
*A63H 11/06* (2006.01)
*A63H 13/10* (2006.01)
(Continued)

(52) U.S. Cl.
CPC ..... *A63H 13/10* (2013.01); *A63H 17/006* (2013.01); *F41B 15/00* (2013.01)

(58) Field of Classification Search
CPC ..... A63H 13/10; A63H 17/006; F41B 15/00
(Continued)

(56) References Cited

U.S. PATENT DOCUMENTS 2,046,652 A 7/1936 Peake et al.
3,116,528 A * 1/1964 Poe ..... A47B 95/02 411/15

(Continued)

FOREIGN PATENT DOCUMENTS

CN 2078645 U 6/1991
GB 171649 A 11/1921

(Continued)

OTHER PUBLICATIONS

International Search Report in corresponding international application No. PCT/EP2014/054840, dated Jun. 11, 2014.

(Continued)

*Primary Examiner* — Vishu Mendiratta
(74) *Attorney, Agent, or Firm* — Day Pitney LLP

(57) ABSTRACT

The shooting toy (1) includes a shooter (5) and a projectile (4) to be ejected from the shooter. A trigger element (6) is movably mounted in a shooter body (7) and has a pusher part (10) adapted to push the projectile (4) away from its loaded position. The shooter (5) is adapted to eject the projectile (4) along a centre axis of a cylindrical surface of the projectile (4). A pinching element (8) is adapted to prevent ejection in said direction of the projectile (4) in its loaded position in the shooter body (7) by means of frictional force acting between a pinching surface of the pinching element (8) and the cylindrical surface of the projectile (4). The pinching surface is adapted to guide the cylindrical surface of the projectile (4) in the ejection direction.

7 Claims, 6 Drawing Sheets

(51) Int. Cl.
*A63H 17/00* (2006.01)
*F41B 15/00* (2006.01)

(58) Field of Classification Search
USPC ..... 446/309, 473; 124/55, 37, 79, 31, 41.1, 124/45, 83, 85; 273/317.7, 317.9, 336, 273/337, 364, 343
See application file for complete search history.

(56) References Cited

U.S. PATENT DOCUMENTS 3,233,353 A 2/1966 Lahr
3,365,836 A * 1/1968 Lim ..... F41B 7/08 124/26
3,415,420 A * 12/1968 White ..... F41B 7/003 222/79
3,430,620 A * 3/1969 Davis ..... F41B 7/08 124/27
3,859,977 A * 1/1975 Lange ..... F41B 11/00 124/27
4,195,615 A * 4/1980 Belokin ..... F41B 7/02 124/16
4,277,068 A 7/1981 Sasaki
4,569,666 A 2/1986 Wolf
5,329,660 A * 7/1994 Fowler ..... F41B 11/87 15/104.061
5,343,850 A * 9/1994 Steer ..... F41B 11/66 124/59
6,460,527 B1 10/2002 Doepner
6,824,442 B2 * 11/2004 Andrews ..... A63H 30/04 446/175
2004/0087241 A1 5/2004 Felix et al.
2008/0035134 A1 * 2/2008 Nordstog ..... A01M 3/027 124/16
2009/0071456 A1 * 3/2009 Chia ..... F41B 7/08 124/16
2014/0090630 A1 * 4/2014 Bird ..... F41B 7/08 124/31

FOREIGN PATENT DOCUMENTS

JP 10-216370 A 8/1998
WO 20020064230 A1 8/2002

OTHER PUBLICATIONS

Notification of Transmittal and International Preliminary Report on Patentability in corresponding international application No. PCT/EP2014/054840 with amended sheets of specification and claims, dated Apr. 8, 2015.
PCT International-Type Search Report, for related Danish patent application No. PA 2013 70148, date of completion: Jun. 19, 2013.
Danish Patent and Trademark Office Search Report, for related Danish patent application No. PA 2013 70148, date of completion: Oct. 25, 2013.

* cited by examiner

SHOOTING TOY

CROSS-REFERENCE TO RELATED APPLICATIONS

This application is the U.S. National Stage Application of International Application No. PCT/EP2014/054840, filed on 12 Mar. 2014, and published on 18 Sep. 2014 as WO 2014/140102 A1, which claims the benefit of priority to Danish Patent Application Serial No. PA 2013 70148, filed on 12 Mar. 2013, the disclosure and teachings of which are incorporated herein by reference.

The present invention relates to a shooting toy including a shooter and a projectile to be ejected from the shooter, the shooter including a shooter body, at least one pinching element adapted to pinch the projectile and thereby hold it in the shooter body in a loaded position and a trigger element being movably mounted in the shooter body between a passive position, in which the projectile may occupy its loaded position in the shooter body, and an activated position, the trigger element having a pusher part adapted to push the projectile away from its loaded position when the trigger element is moved from its passive position to its activated position, the trigger element having a finger touch part adapted to be activated by an operator, and the projectile having a cylindrical surface.

U.S. Pat. No. 4,277,068 discloses a flying saucer toy consisting of a pistol and a flying disc to be fired from said pistol. The pistol includes a pair of resilient pinching blades between which the flying disc is retained in its loaded position, one pinching blade having a first relatively high friction corner while the other having a second slippery or relatively low friction corner. In the loaded position of the disc, the disc is gripped mechanically between said first and second corners as these corners are spaced slightly less from each other than the diameter of the disc, thereby holding around the periphery of the disc. As the disc is launched, a thrust is being provided by the pinching blades to the disc, being transformed into a torque between the first relatively high friction corner and the second slippery or relatively low friction corner, thereby rotating the disc. The flying disc has an inwardly concave bottom adapted to receive a lift efficiently. However, because of its configuration adapted to apply a rotating movement to the flying saucer, this toy is specifically suitable to eject a flat, disc-formed element and not a projectile having another form, such as for instance a ball or a short stud-formed element. Furthermore, this toy would be difficult to operate in a relatively small scale version, because a suitably sized handle is necessary in order to hold the device when operating the trigger.

JP10216370 A discloses a similar flying saucer toy consisting of a pistol and a flying disc to be fired from said pistol. In the loaded position of the disc, the disc is gripped mechanically between two opposed half-circular arms abutting the periphery of the disc, thereby mechanically locking the disc in position. This toy is also specifically suitable to eject a flat, disc-formed element and not a projectile having another form, such as for instance a ball or a short stud-formed element. This toy would also be difficult to operate in a relatively small scale version, because a suitably sized handle is necessary in order to hold the device when operating the trigger.

U.S. Pat. No. 6,460,527 B1 discloses a projectile and launcher combination, in which the launcher is formed with a tubular passage having a convergently tapered inner end. A projectile element is provided at its back end with a plurality of rearwardly extending, cantilever mounted resilient leaf spring elements arranged to be received in and displaced radially inward by the convergently tapered portion of the tubular passage. When the projectile is loaded into the launcher, the leaf spring elements tend to eject it forwardly. A retention arrangement is provided to hold the projectile until it is ready to be ejected: A guide shaft extends rearwardly well beyond the free ends of the leaf spring elements and is provided with a rounded annular enlargement adapted to be received in a shallow annular groove in the launcher. Thus, during the last portion of the projectile loading operation, extra force must be applied to the projectile element to force it in place. When the projectile is released from retention, the outward pressure of the leaf spring elements on the convergent walls forcibly ejects the projectile from the launcher passage. However, this toy is only suitable for a relatively long projectile, because the projectile must be provided with said preloaded, resilient leaf spring elements. Furthermore, these leaf spring elements will lose their elasticity over time, so that if the projectile has been loaded in the launcher for instance during a period of one year or more, leaf spring elements will not operate properly anymore. This may indeed not be satisfactorily for quality toy products, as these are often stored for years and then reused for younger children.

The prior art shooting toys discussed above are specifically suitable for either disc-shaped or missile-shaped projectiles. For instance, these prior art shooting toys are not suitable for ejecting a certain well known, relatively small circular coupling device being one of the various plastic toy construction elements available under the name LEGO (registered trademark). This circular coupling device, in this description denoted the 1×1 circular stud coupling, is provided in the form of a rotationally symmetrical unit and comprises a coupling stud on its top surface and a coupling skirt on its underside which is complementary relative to the coupling stud so that two of these coupling devices may be interconnected or that they may be connected to any one of the above-mentioned several other various plastic toy construction elements available under the name LEGO.

The object of the present invention is to provide a simple shooting toy suitable for ejecting a relatively small projectile.

In view of this object, the shooter is adapted to eject the projectile along a centre axis of the cylindrical surface of the projectile, the at least one pinching element is adapted to prevent ejection in said direction of the projectile in its loaded position in the shooter body by means of frictional force acting between at least one pinching surface of the at least one pinching element and the cylindrical surface of the projectile, and said at least one pinching surface is adapted to guide the cylindrical surface of the projectile in the ejection direction of the projectile along the centre axis of the cylindrical surface of the projectile during ejection of the projectile.

In this way, a stationary frictional force acting between the pinching surface of the pinching element and the cylindrical surface of the projectile may retain the projectile in its loaded position during the building-up of a suitable ejection force acting on the projectile by means of the pusher part of the trigger element. When the required ejection force is reached, the stationary friction force may be overcome and the projectile may be released and may be ejected powerfully enough to fly a certain distance through the air.

In an embodiment, the at least one pinching element has the form of a tubular or at least partly or substantially tubular element adapted to interact with the cylindrical surface of the projectile by means of the at least one pinching surface.

Thereby, in its simplest form, the tubular or at least partly or substantially tubular element may have a cylindrical face forming the pinching surface or being provided with one or more pinching surfaces. For instance, the above-mentioned 1×1 circular stud coupling may be loaded by inserting the coupling stud on its top surface into the tubular or at least partly or substantially tubular element forming the pinching element or, alternatively, said tubular or at least partly or substantially tubular element forming the pinching element may be inserted into the coupling skirt on the underside of the stud coupling.

In an embodiment, the tubular or at least partly or substantially tubular element forming the at least one pinching element, at least along a part of its length, is divided into parts by means of at least one cut-out in a wall of said element. Thereby, the part or parts of the wall formed between the at least one cut-out in the wall, depending on the material forming the pinching element, may be allowed to flex, preferably elastically, more or less, whereby a larger frictional force may be build up between the pinching surface of the pinching element and the cylindrical surface of the projectile when the projectile is inserted into its loaded position in the shooter body.

In an embodiment, the at least one pinching surface has the form of a raised surface on an at least partly cylindrical surface of the tubular or at least partly or substantially tubular element. Thereby, by a certain limitation of the extent of the contact surface between the pinching surface and the cylindrical surface of the projectile, it may be ensured that the pinching surface is in fact evenly pressed suitably against part of the cylindrical surface of the projectile, also in the case that the pinching element is allowed to flex elastically during insertion of the projectile. If, on the other hand, the pinching surface would be formed almost entirely by a cylindrical surface of the tubular or at least partly or substantially tubular element, flexing of the pinching element could result in the pinching surface being not evenly pressed against the cylindrical surface of the projectile.

In an embodiment, the shooter body is at least partly formed by a tubular or at least partly or substantially tubular element having a first part forming the at least one pinching element and having a second part accommodating the trigger element. Thereby, a compact device may be obtained.

In an embodiment, the trigger element is mounted pivotally in a slot in a wall of the shooter body so that the pusher part is located inside the at least partly or substantially tubular element and so that the finger touch part is located outside said element.

In an embodiment, the trigger element is so arranged in the shooter body that a line extending through the pusher part and the finger touch part forms an acute angle with a central axis of the tubular or at least partly or substantially tubular element of the shooter body. Thereby, it may be possible triggering the shooting toy simply by pressing it between two fingertips, one fingertip pressing the finger touch part of the trigger element and the other fingertip pressing an opposed part of the shooter body. Thereby operation of even very small-scale versions of the shooting toy may be facilitated.

In an embodiment, the trigger element has a V-formed part, each leg of the V-form forming a separate pusher part at its end, and the entire trigger element is symmetrical or substantially symmetrical about the symmetry axis of the V-form. Thereby, the trigger element may be mounted in the shooter body by the user without possibility of mounting the trigger element wrong.

In an embodiment, the projectile has the form of a circular stud coupling in the form of a rotationally symmetrical unit comprising a coupling stud on its top surface and a coupling skirt on its underside which is complementary relative to the coupling stud, wherein the at least one pinching element is adapted to interact with the coupling stud of the projectile, and wherein the shooter body, opposite the at least one pinching element, is provided with a coupling stud corresponding to the coupling stud of the circular stud coupling and adapted to interconnect with the coupling skirt of the circular stud coupling. Thereby, a number of spare projectiles may be stored on the shooter body by connecting them to the coupling stud of the shooter body.

The invention will now be explained in more detail below by means of examples of embodiments with reference to the very schematic drawing, in which FIG. 1 is a perspective view of a Lego minifigure holding a shooting toy according to the invention;

Figure 1:
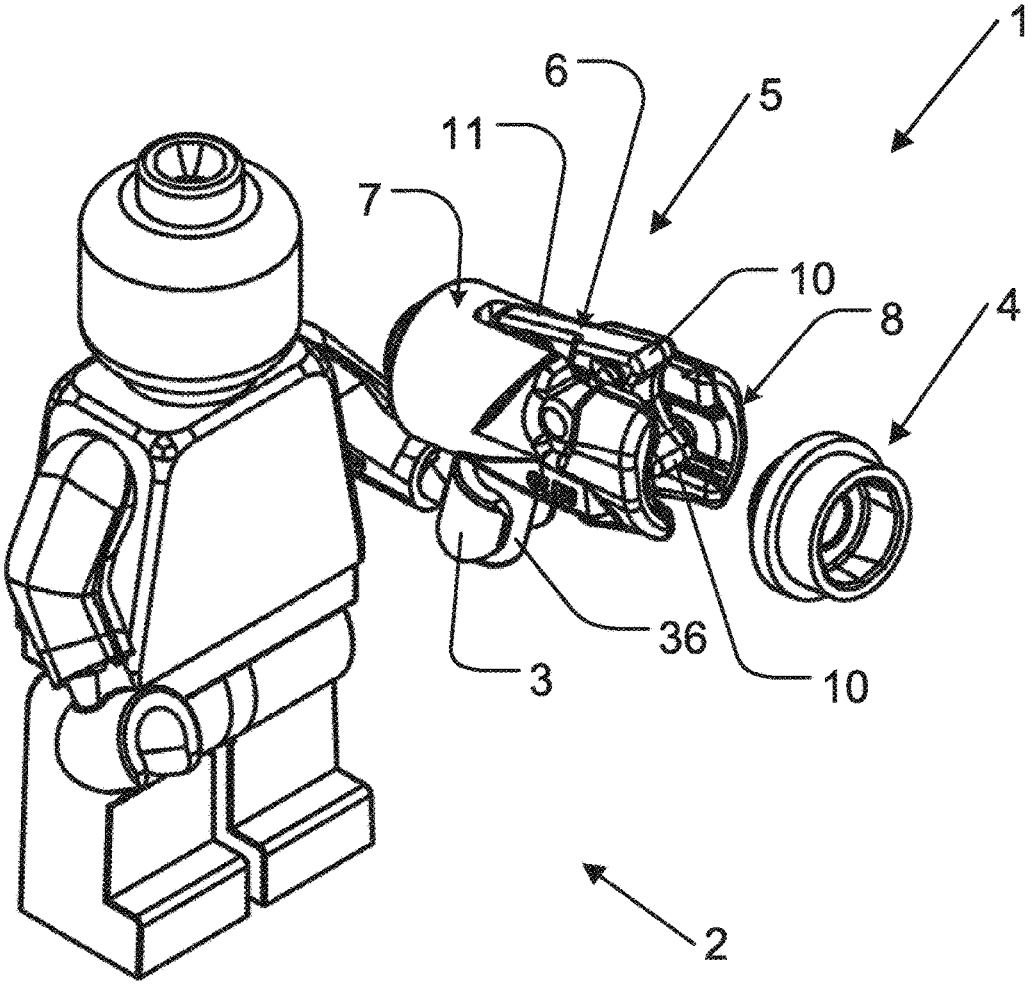
Figure 16:
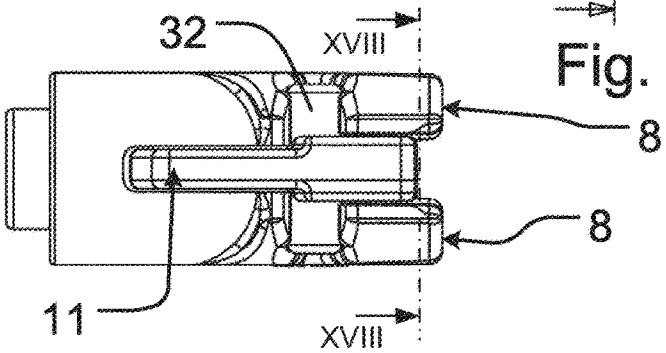
Figure 17:
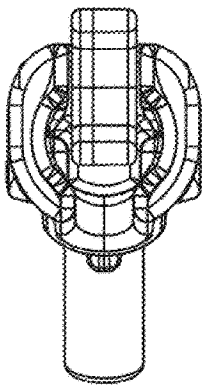
Figure 18:
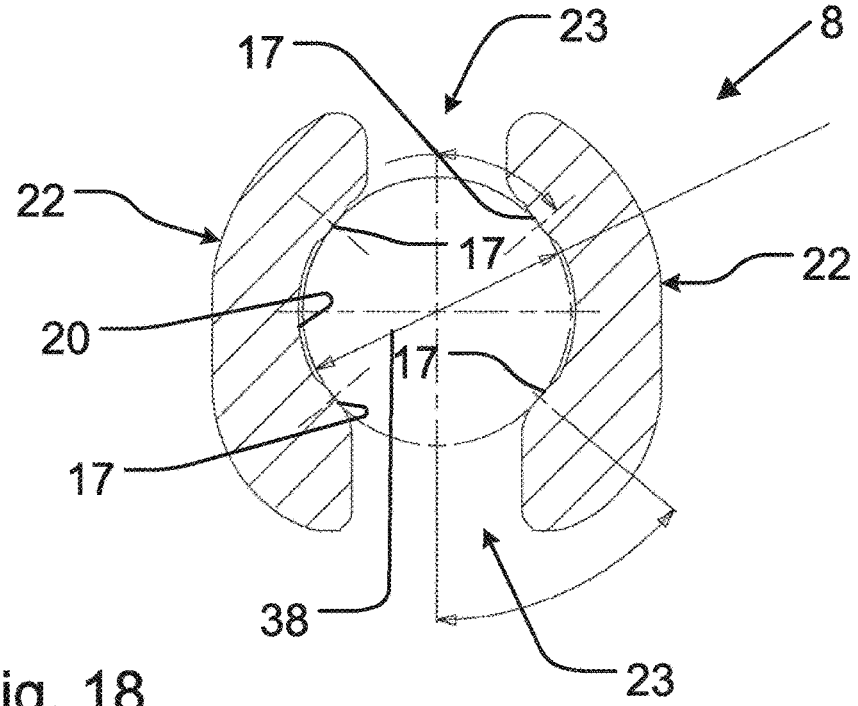
Figure 19:
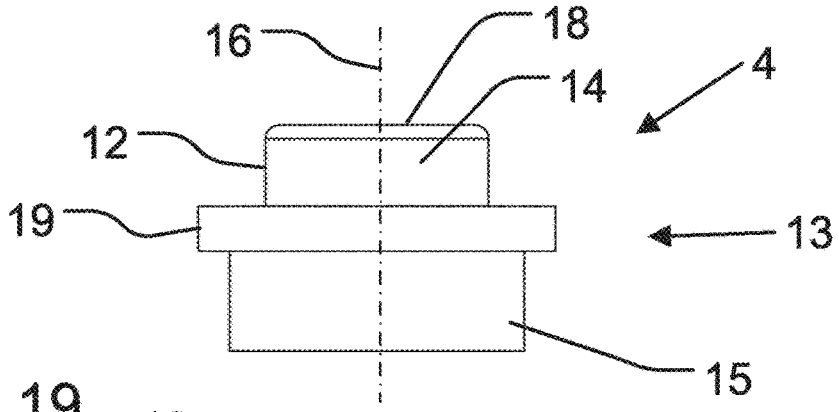

FIGS. 13 to 17 correspond to FIGS. 7 to 10 and 12, respectively, however, without a projectile loaded;

FIG. 18 is a cross-section through the shooting toy in FIG. 16 taken along the line XVIII-XVIII;

FIG. 19 is a side view of a projectile as shown in FIG. 1; and

Figure 20:
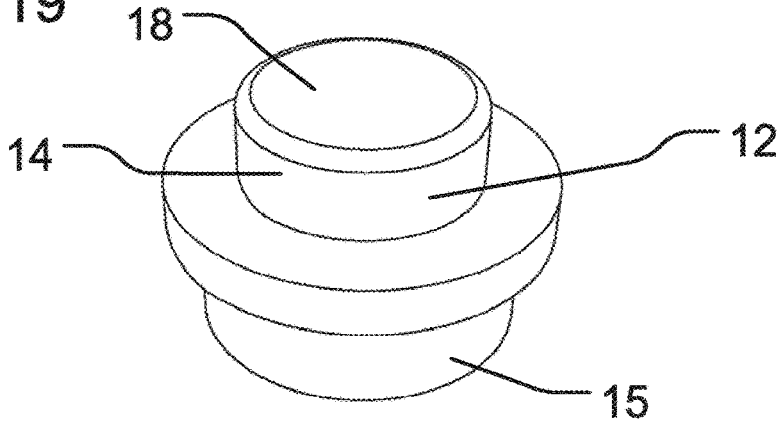

FIG. 20 is a perspective view of the projectile in FIG. 19.

FIG. 1 illustrates a Lego minifigure 2 holding a shooter 5 of a shooting toy 1 according to the present invention in a left hand 3, whereby a projectile 4 in the form of the above-described 1×1 circular stud coupling is just ejected from the shooter 5 of the shooting toy 1. The projectile 4 is ejected by pressing a trigger element 6 by means of a finger of the user, for instance a child playing with the minifigure 2.

Figure 2:
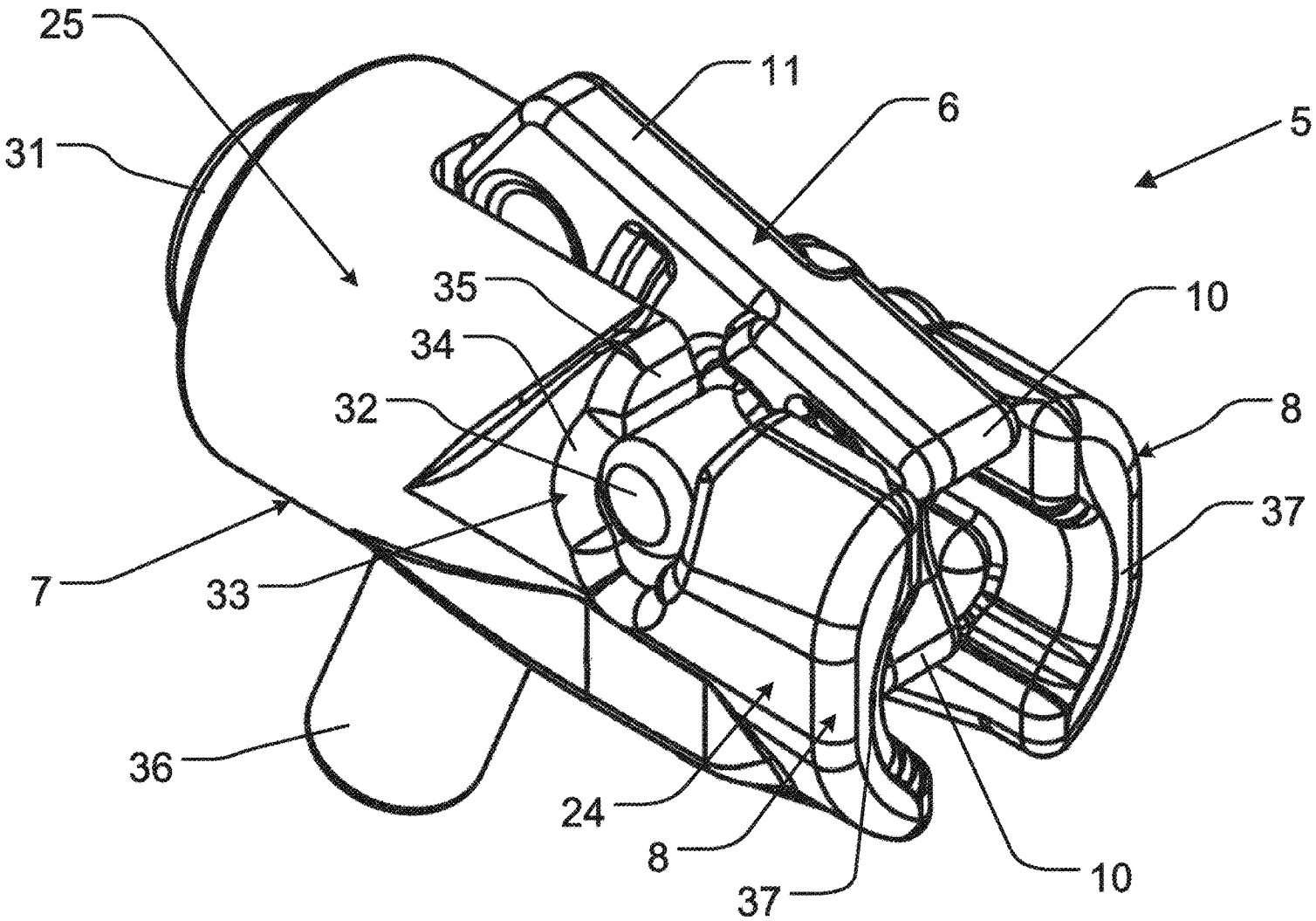
FIG. 2 is a perspective view of a shooting toy according to the invention, however, without a projectile loaded.

FIG. 2 illustrates the shooter 5 in greater detail, however without the projectile 4. The shooter 5 includes a shooter body 7, a pinching element 8 adapted to pinch the projectile 4 and thereby hold it in the shooter body 7 in a loaded position as for instance illustrated in FIGS. 7 and 9. The shooter 5 furthermore includes the trigger element 6 being movably mounted in the shooter body 7 between a passive position, in which the projectile 4 may occupy its loaded position in the shooter body 7, as for instance illustrated in FIGS. 2, 7 and 9, and an activated position, as for instance illustrated in FIGS. 1, 13 and 15.

The trigger element 6 has a pusher part 10 adapted to push the projectile 4 away from its loaded position when the trigger element 6 is moved from its passive position to its activated position, so that the projectile 4 may be ejected from the shooter body 7. The trigger element 6 furthermore has a finger touch part 11 adapted to be activated by the finger of an operator. Although this finger touch part 11 conveniently may be activated by pressing it by means of the tip of a finger, of course, it may also be activated by any other suitable means, such as by means of a toy tool, for instance a toy brick or the like.

As explained above, the projectile 4 may have the form of a 1×1 circular stud coupling 13, illustrated for instance in FIG. 20. The 1×1 circular stud coupling 13 is provided in the form of a rotationally symmetrical unit and comprises a coupling stud 14 on its top surface and a coupling skirt 15 on its underside which is complementary relative to the coupling stud 14 so that two of these coupling devices may be interconnected by insertion of the coupling stud 14 of one coupling device into the coupling skirt 15 of another coupling device, as it is well known, or that they may be connected to any one of the abovementioned several other various plastic toy construction elements available under the name LEGO. The coupling stud 14 has a top surface 18 which the pusher part 10 of the trigger element 6 may abut when the projectile 4 is to be ejected. As illustrated in FIGS. 19 and 20, the 1×1 circular stud coupling 13 has a cylindrical part 19 between the coupling stud 14 the coupling skirt 15. However, the projectile 4 may also be a not shown, however well known, 1×1 square stud coupling having a square skirt instead of the cylindrical part 19 and the circular coupling skirt 15 of the illustrated 1×1 circular stud coupling 13.

As also illustrated in FIG. 20, the projectile 4 has a cylindrical surface 12. The shooter 5 is adapted to eject the projectile 4 along a centre axis 16 of the cylindrical surface 12 of the projectile 4, as illustrated for instance in FIGS. 1 and 9.

The pinching element 8 is adapted to prevent ejection in the abovementioned direction of the projectile 4 in its loaded position in the shooter body 7 by means of frictional force acting between pinching surfaces 17 of the pinching element 8 and the cylindrical surface 12 of the projectile 4. Furthermore, as it will be understood, said pinching surfaces 17 are adapted to guide the cylindrical surface 12 of the projectile 4 in the ejection direction of the projectile 4 along the centre axis 16 of the cylindrical surface 12 of the projectile 4 during ejection of the projectile 4.

In the illustrated embodiment, the pinching element 8 has the form of a tubular or at least partly or substantially tubular element adapted to interact with the cylindrical surface 12 of the projectile 4 by means of four pinching surfaces 17, each having the form of a raised surface on a cylindrical surface 20 of the tubular or at least partly or substantially tubular element forming the pinching element 8, as illustrated in FIG. 18. The distance between two opposed pinching surfaces 17 is slightly smaller than the diameter of the cylindrical surface 20. Any suitable number of pinching surfaces 17 is possible, and the pinching surfaces 17 may simply be positioned on a diameter 38 being slightly smaller than the diameter of the cylindrical surface 20.

Furthermore, as illustrated in FIG. 18, the tubular or at least partly or substantially tubular element forming the at least one pinching element 8, is divided into two opposed parts 22 by means of two opposed cut-outs 23 in a wall 21 of said element. The tubular or at least partly or substantially tubular element forming the at least one pinching element 8 may be divided into any suitable number of parts, such as three, four, five or even any larger number.

The shooter body 7 is at least partly formed by a tubular or at least partly or substantially tubular element having a first part 24 forming the at least one pinching element 8 and having a second part 25 accommodating the trigger element 6. The trigger element 6 is mounted pivotally in a slot 26 in a wall 27 of the shooter body 7 so that the pusher part 10 is located inside the at least partly or substantially tubular element and so that the finger touch part 11 is located outside said element. The trigger element 6 is provided with pivot pins 32 adapted to be mounted in bearings 33 in the wall 27 of the shooter body 7. The bearings 33 are adapted to elastically flex and thereby grip the pivot pins 32 when the user presses the pivot pins 32 into engagement with the bearings 33. The bearings 33 therefore has a first section 34 with a diameter corresponding to or slightly larger than that of the pivot pins 32 and a second section 35 with a cross-sectional dimension slightly smaller than said diameter.

The shooter body 7 is provided with a handle 36 in the form of a slightly angled pin extending downwardly from the lower part of the shooter body 7 so that a Lego minifigure 2 may hold the shooter 5 in its hand 3 by said handle 36.

Figures 7, 8, 9, 10, 11, 12:
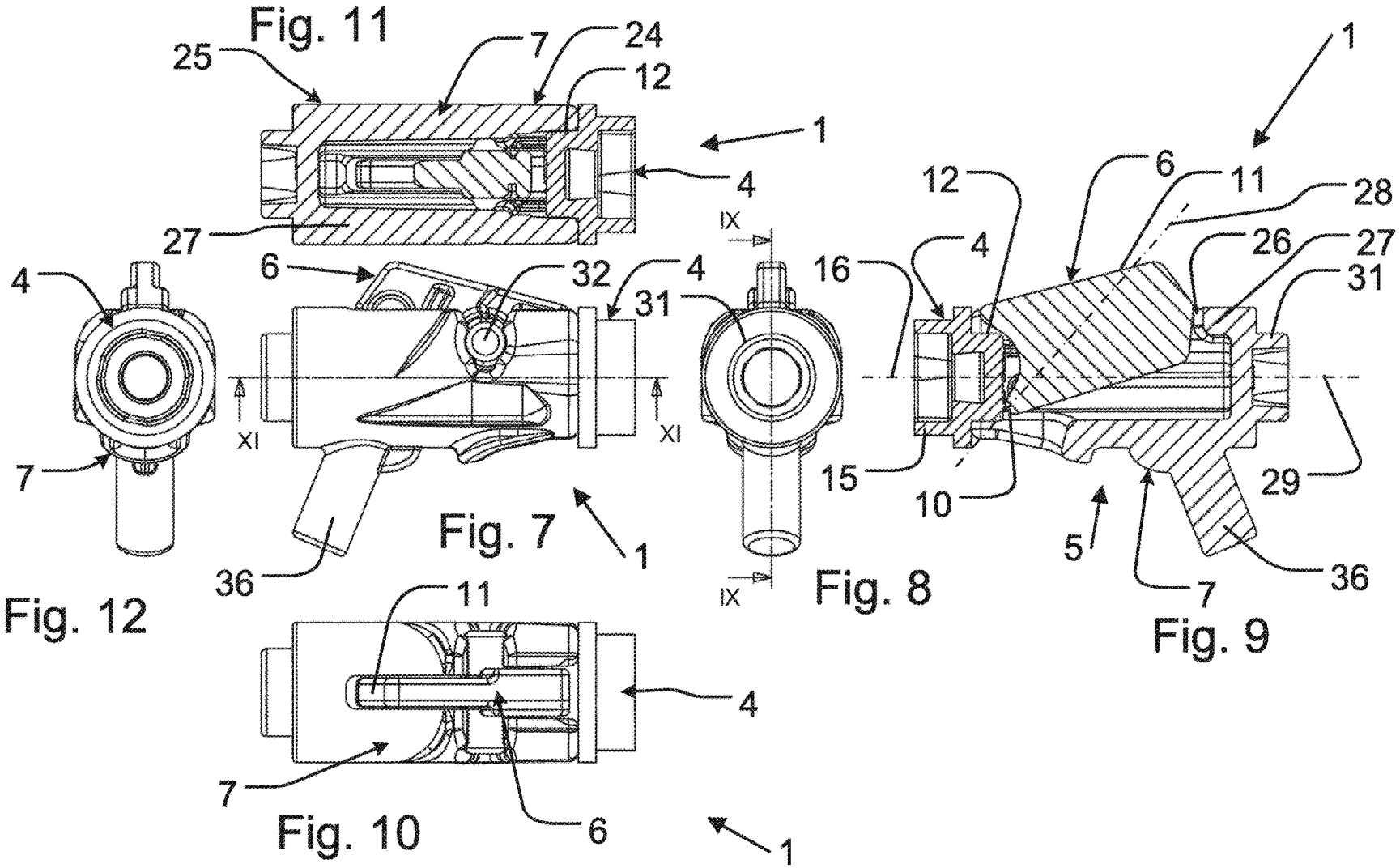
FIG. 7 is a side view of the shooting toy in FIG. 2, however with a projectile loaded.
FIG. 8 is an end view of the shooting toy in FIG. 7, seen from the left side.
FIG. 9 is an axial section through the shooting toy in FIG. 8 taken along the line IX-IX.
FIG. 10 is a top view of the shooting toy in FIG. 7.
FIG. 11 is an axial section through the shooting toy in FIG. 7 taken along the line XI-XI.
FIG. 12 is an end view of the shooting toy in FIG. 7, seen from the right side.
Figure 15:
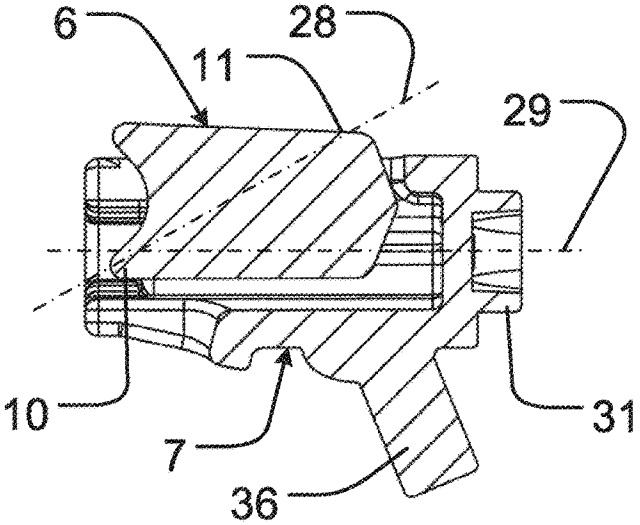
Figure 14:
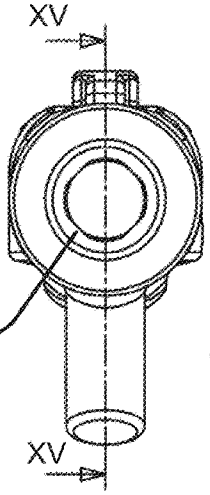
Figure 13:
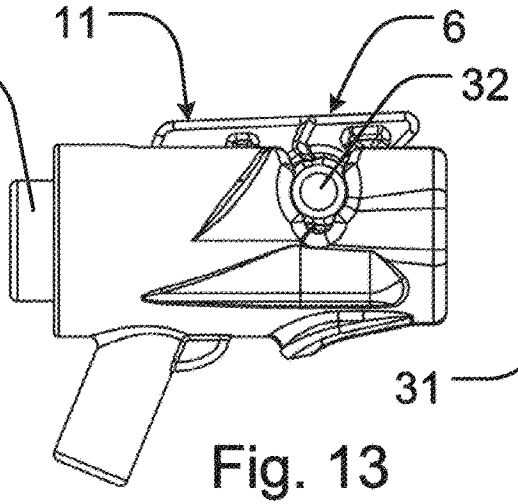

The trigger element 6 is so arranged in the shooter body 7 that a line 28 extending through the pusher part 10 and the finger touch part 11 forms an acute angle with a central axis 29 of the tubular or at least partly or substantially tubular element of the shooter body 7, as illustrated in FIGS. 9 and 15. Thereby, it may be possible triggering the shooting toy 1 simply by pressing it between two fingertips, one fingertip pressing the finger touch part of the trigger element and the other fingertip pressing an opposed part of the shooter body. Thereby operation of even very small-scale versions of the shooting toy may be facilitated. Preferably, the shooter body 7 has a diameter of less than 15 mm, more preferred less than 12 mm and most preferred less than 10 mm. Preferably, the shooter body 7 has a length of less than 25 mm, more preferred less than 20 mm and most preferred less than 18 mm.

Figures 3, 4, 5, 6:
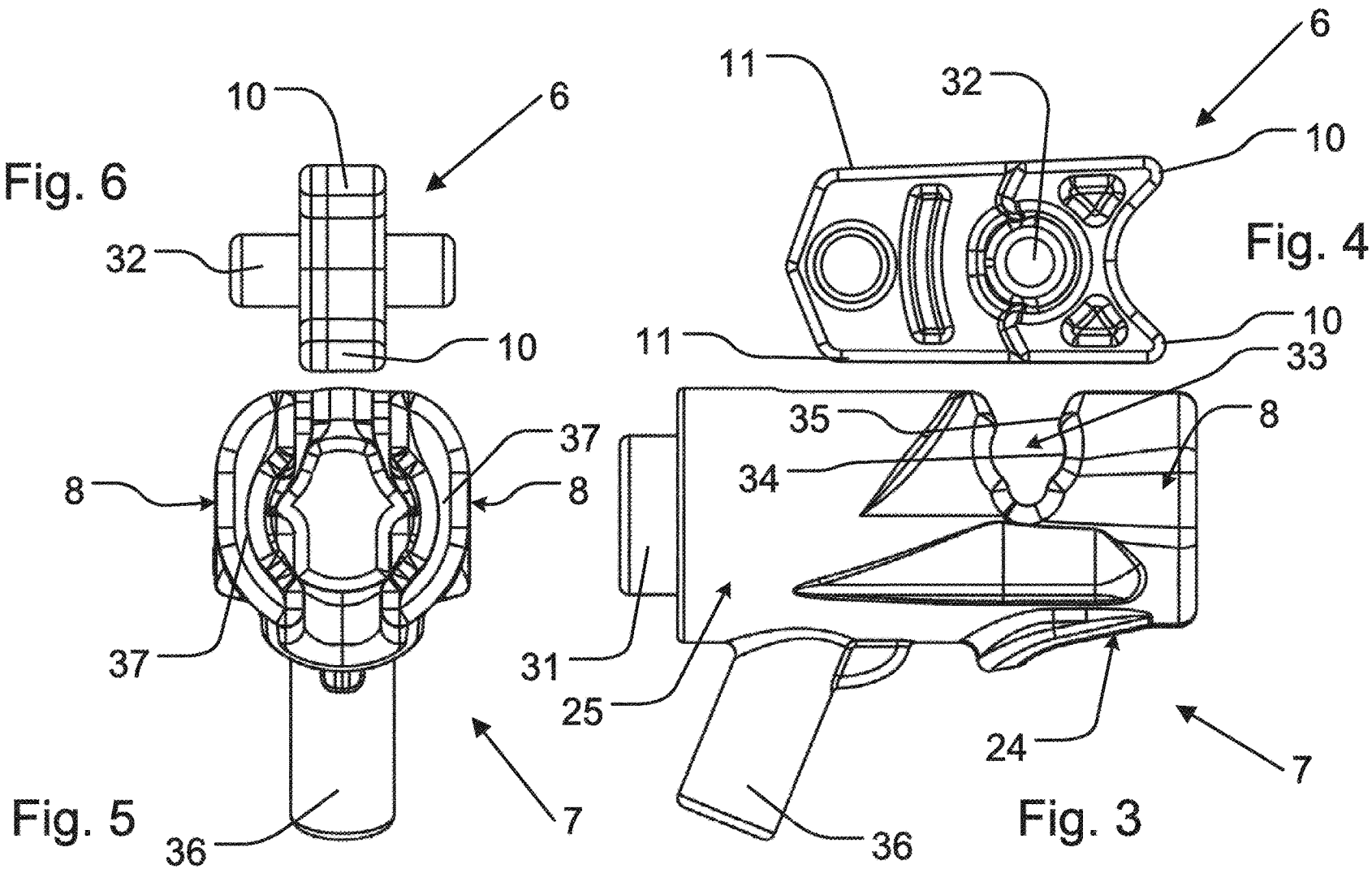
FIG. 3 is a side view of the shooter body of the shooting toy in FIG. 2.
FIG. 4 is a side view of the trigger element of the shooting toy in FIG. 2.
FIG. 5 is an end view of the shooter body in FIG. 3, seen from the right side.
FIG. 6 is an end view of the trigger element in FIG. 4, seen from the right side.

The trigger element 6 has a V-formed part 30, each leg of the V-form forming a separate pusher part 10 at its end, and the entire trigger element 6 is symmetrical or substantially symmetrical about the symmetry axis of the V-form as best illustrated in FIG. 4.

As illustrated in the figures, opposite the pinching element 8, the shooter body 7 is provided with a coupling stud 31 corresponding to the coupling stud 14 of the 1×1 circular stud coupling 13 and adapted to interconnect with the coupling skirt 15 of the 1×1 circular stud coupling 13, thereby enabling the user to store a number of projectiles 4 on the back of the shooter body 7.

Advantageously, the pinching element 8 and possibly the shooter body 7 may be formed, for instance by injection moulding, from ABS which among its properties has good toughness and rigidity, low creep, and good dimensional stability. Thereby, the pinching element 8 may retain its elasticity over a very long time, such as 10 years or more.

In the embodiment illustrated in the figures, it may be understood that the projectile 4, in its loaded position, is held practically only by friction force between the pinching surfaces 17 and the cylindrical surface 12 of the projectile 4. Furthermore, it may be understood that in the loaded position of the projectile 4 in the shooter body 7, the two opposed parts 22 of the pinching element 8 may be flexed slightly away from each other in relation to a resting position that they take up when the projectile 4 is not loaded. This may be obtained by forming the diameter on which the pinching surfaces 17 are located in the resting position of the two opposed parts 22 slightly smaller than the diameter of the cylindrical surface 12 of the projectile 4, such as, for instance, more than 1%, more than 3% or even more than 5% smaller. By this arrangement, it may be obtained that a larger friction force is present between the pinching surfaces 17 and the cylindrical surface 12 of the projectile 4 in the loaded position of the projectile 4. Furthermore, thereby it may be possible to slightly boost the ejection of the projectile 4 just before it leaves the shooter body 7 by rounding a tip end 37 of the pinching surfaces 17 so that this rounded tip end 37 may "kick" the projectile 4 in the ejection direction as the two opposed parts 22 flex back to their resting position. It may also be understood, that in the embodiment illustrated in the figures, the two opposed parts 22 of the pinching element 8 are not flexed further away from each other during ejection of the projectile 4. However, in a not shown embodiment, this could be the case, if the two or more opposed parts 22 of the pinching element 8 were formed with a slightly hook-formed tip end gripping over the cylindrical part 19 or other part of the 1×1 circular stud coupling 13 in the loaded position of the projectile 4.

The invention claimed is:

1. A shooting toy comprising:

a circular projectile having a cylindrical surface extending along a center axis and having a coupling stud on a top surface thereof and a coupling skirt on the bottom surface thereof and an outwardly-extending cylindrical part therebetween, the coupling skirt being complementarily configured to connect to the coupling stud;

a shooter comprising:

a shooter body comprising at least one substantially tubular pinching element, the at least one substantially tubular pinching element consisting of two opposed, inner pinching surfaces, one or more cutouts between said opposed, inner surfaces, and a rounded tip end, wherein in a loaded position, the opposed, inner pinching surfaces of the substantially tubular pinching element are configured to pinch the projectile along an outer surface of the coupling stud and thereby hold it in the shooter body, and whereby in a non-engaged position, the opposed, inner pinching surfaces are configured to extend slightly away from one another and release the projectile;

a trigger element having a finger touch part adapted to be activated by an operator; and a pusher part adapted to push the projectile away from its loaded position when the trigger element is moved from a passive position to an activated position;

the trigger element being movably mounted in the shooter body between the passive position, in which the projectile may occupy the loaded position in the shooter body, and the activated position in which the shooter is configured to eject the projectile along the center axis of the cylindrical surface of the projectile;

wherein the projectile is configured to be held within the substantially tubular pinching element of the shooter body by the frictional force until suitable ejection force is created by the pusher part; and wherein the opposed, inner pinching surfaces of the substantially tubular pinching element are adapted to guide the cylindrical surface of the projectile in the ejection direction of the projectile, against the frictional force, and along the center axis of the cylindrical surface of the projectile during ejection of the projectile.

2. A shooting toy according to claim 1, wherein the at least one pinching surface has the form of a raised surface on an at least partly cylindrical surface of the at least substantially tubular pinching element.

3. A shooting toy according to claim 1, wherein the shooter body is at least partly formed by the at least substantially tubular pinching element having a first part forming the pinching surfaces and having a second part accommodating the trigger element.

4. A shooting toy according to claim 3, wherein the trigger element is mounted pivotally in a slot in a wall of the shooter body so that the pusher part is located inside the at least substantially tubular pinching element and so that the finger touch part is located outside said substantially tubular pinching element.

5. A shooting toy according to claim 4, wherein the trigger element is so arranged in the shooter body that a line extending through the pusher part and the finger touch part forms an acute angle with a central axis of the at least substantially tubular pinching element of the shooter body.

6. A shooting toy according to claim 1, wherein the trigger element has a V-formed part, each leg of the V-form forming a separate pusher part at its end, and wherein the entire trigger element is symmetrical or substantially symmetrical about the symmetry axis of the V-form.

7. A shooting toy according to claim 1, wherein the projectile has the form of a circular stud coupling in the form of a rotationally symmetrical unit comprising:

a coupling stud on its top surface and a coupling skirt on its underside which is complementary relative to the coupling stud, wherein the at least one substantially tubular pinching element is adapted to interact with the coupling stud of the projectile, and wherein the shooter body, opposite the at least one substantially tubular pinching element, is provided with a coupling stud corresponding to the coupling stud of the circular stud coupling and adapted to interconnect with the coupling skirt of the circular stud coupling.

* * * * *